US005254938A

United States Patent [19]

Ito

[11] Patent Number: 5,254,938

[45] Date of Patent: Oct. 19, 1993

[54] RESISTOR CIRCUIT WITH REDUCED TEMPERATURE COEFFICIENT OF RESISTANCE

[75] Inventor: Hajime Ito, Ichinomiya, Japan

[73] Assignee: Nippondenso Co. Ltd., Kariya, Japan

[21] Appl. No.: 871,345

[22] Filed: Apr. 21, 1992

[30] Foreign Application Priority Data

Apr. 26, 1991 [JP] Japan ..... 3-125526
Jun. 11, 1991 [JP] Japan ..... 3-166491

[51] Int. Cl.[5] ..... H01C 7/13

[52] U.S. Cl. ..... 323/369; 323/312; 338/22 R

[58] Field of Search ..... 323/312, 313, 369

[56] References Cited

U.S. PATENT DOCUMENTS

| | | | |
|---|---|---|---|
| 3,836,340 | 9/1974 | Conwicke | 338/22 R |
| 4,101,820 | 7/1978 | Montanari | 323/369 |
| 4,181,878 | 1/1980 | Murari et al. | 323/369 |
| 4,317,054 | 2/1982 | Caruso et al. | 323/313 |
| 4,332,081 | 6/1982 | Francis | 338/22 R |
| 4,531,111 | 7/1985 | Schmidt et al. | 323/369 |
| 4,570,115 | 2/1986 | Misawa et al. | 323/313 |
| 4,584,553 | 4/1986 | Tokura et al. | 338/320 |
| 4,952,902 | 8/1990 | Kawaguchi et al. | 338/22 R |
| 5,012,178 | 4/1991 | Weiss et al. | 323/312 |

FOREIGN PATENT DOCUMENTS 62-169301 7/1987 Japan .

OTHER PUBLICATIONS

IEEE Transactions on components, hybrids, and manufacturing technology, vol. CHMT-7, No. 2, Jun. 1984 The Microstructure of RuO2 thick Film Resistors & the Influence of Glass Particle Size on their Electrical Properties. Toshio Inokuma, et al.

*Primary Examiner*—Jeffrey Sterrett
*Attorney, Agent, or Firm*—Cushman, Darby & Cushman

[57] ABSTRACT

A resistor circuit which includes a pair of linear conductive films and a resistive film. The resistive film is formed on an area between the conductive films and electrically connected to the conductive films. A pair of terminals are electrically connected to portions of the conductive films respectively. A current source is electrically connected between the terminals to flow an electric current between the terminals. A pair of voltage output terminals are electrically connected to portions of the conductive films respectively. At least one of the voltage output terminals is disposed at a position other than a position in which the terminals are formed. An output voltage output from the voltage output terminals is exactly proportional to a current flowing between them without an influence of change of an ambient temperature.

11 Claims, 7 Drawing Sheets

PRIOR ART

RESISTOR CIRCUIT WITH REDUCED TEMPERATURE COEFFICIENT OF RESISTANCE

BACKGROUND OF THE INVENTION

1. Filed of the Invention

The present invention relates to a resistor circuit in which a resistor has a reduced TCR (Temperature Coefficient of Resistance).

2. Description of the Related Art

FIG. 6 shows a conventional constant-current circuit. A resistor 5 is connected to an emitter terminal of a transistor 3 for detecting a current which is fed back to an operational amplifier 4. The operational amplifier 4 controls the transistor 3 so that the voltage of a connecting point between the emitter terminal and the resistor 5 corresponds to a constant-voltage Vc. Thus, the circuit keeps a current which flows into a load 6 constant.

When such a circuit is constructed by a so-called hybrid IC (Integrated Circuit), a thick-film resistor is generally used as the resistor 5. However, when sheet-resistivity of the thick-film resistor is approximately less than 1Ω/□, the thick-film resistor tends to behave metallically. More specifically, the TCR of the thick-film resistor becomes more than +500 ppm/°C. In this case, the resistance of the resistor 5 changes in accordance with variations in ambient temperature. Therefore, the voltage which is fed back to the operational amplifier 4 is changed because of the resistance variation, and this voltage change will vary the current. Therefore, the circuit can not keep the current constant.

A conventional electrode structure for the resistor 5 is shown in FIG. 7. The TCR of a resistive film 2 is comparatively low (approximately +150 ppm/°C.), and its resistance is high. The resistive film 2 is formed on a wide area between linear conductive films 1A and 1B to make resistance between the conductive films 1A and 1B. A terminal 20 shown in FIG. 7 is connected to the emitter terminal shown in FIG. 6, and a terminal 21 is connected to the operational amplifier 4. However, even such an electrode structure has not been able to sufficiently lower the TCR of the resistor 5 to enable constant current in changing ambient temperatures.

SUMMARY OF THE INVENTION

Accordingly, it is an objective of the present invention to provide a resistor circuit in which a resistor has a reduced TCR, lowered enough to allow use in a constant current circuit without effects from ambient temperature.

To accomplish the foregoing and other objects and in accordance with the purpose of the present invention, a resistor circuit which includes a pair of linear conductive films and a resistive film as FIG. 1 shows the preferred embodiment, where the resistive film 2 is formed on an area between the conductive films 1A and 1B and electrically connected to the conductive films 1A and 1B. A pair of terminals (11A and 11B in FIG. 1) are electrically connected to portions of the conductive films respectively. A current source is electrically connected between the terminals to produce an electric current between the terminals. A pair of voltage output terminals are electrically connected to portions of the conductive films; at least one of the voltage output terminals is disposed at a position other than a position in which the terminals 11A and 11B are formed.

This resistor circuit forms the resistive film as a resistor ladder in which four resistance are connected to each other like a ladder as shown in FIGS. 2A and 2B. A voltage $V_1$ is the voltage between the voltage output terminal 13A near the terminal 11A and the conductive film 1B. When the atmospheric temperature rises, the resistance Rr of the resistive film 2 rises, and a current $I_1$ flowing in the resistance Rr rises the causing the voltage $V_1$ to rise. A voltage $V_2$ is defined between the voltage output terminal 13B far from the terminal 11B and the conductive film 1A. When the atmospheric temperature rises, the resistance Rr also rises, a current $I_2$ through the resistance Rr is lowered because the resistance Rc of the conductive films 1A and 1B rises. The voltage $V_2$ is therefore lowered, because the amount of lowering the current $I_2$ is larger than the amount of voltage caused by the rise of the resistance Rr. Therefore, when the ambient temperature rises, the voltage $V_2$ is lowered.

As a result, when the ambient temperature rises, the voltage $V_1$ rises and the voltage $V_2$ lowers. By disposing the voltage output terminals 13A and 13B at different positions the voltage $V_1$ offset the voltage $V_2$. An output voltage output from the voltage output terminals 13A and 13B is therefore of the change of the ambient temperature.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

DESCRIPTION OF THE PREFERRED EMBODIMENTS

The preferred embodiments of the present invention will now be described with reference to the drawings.

First Embodiment

Figure 1:
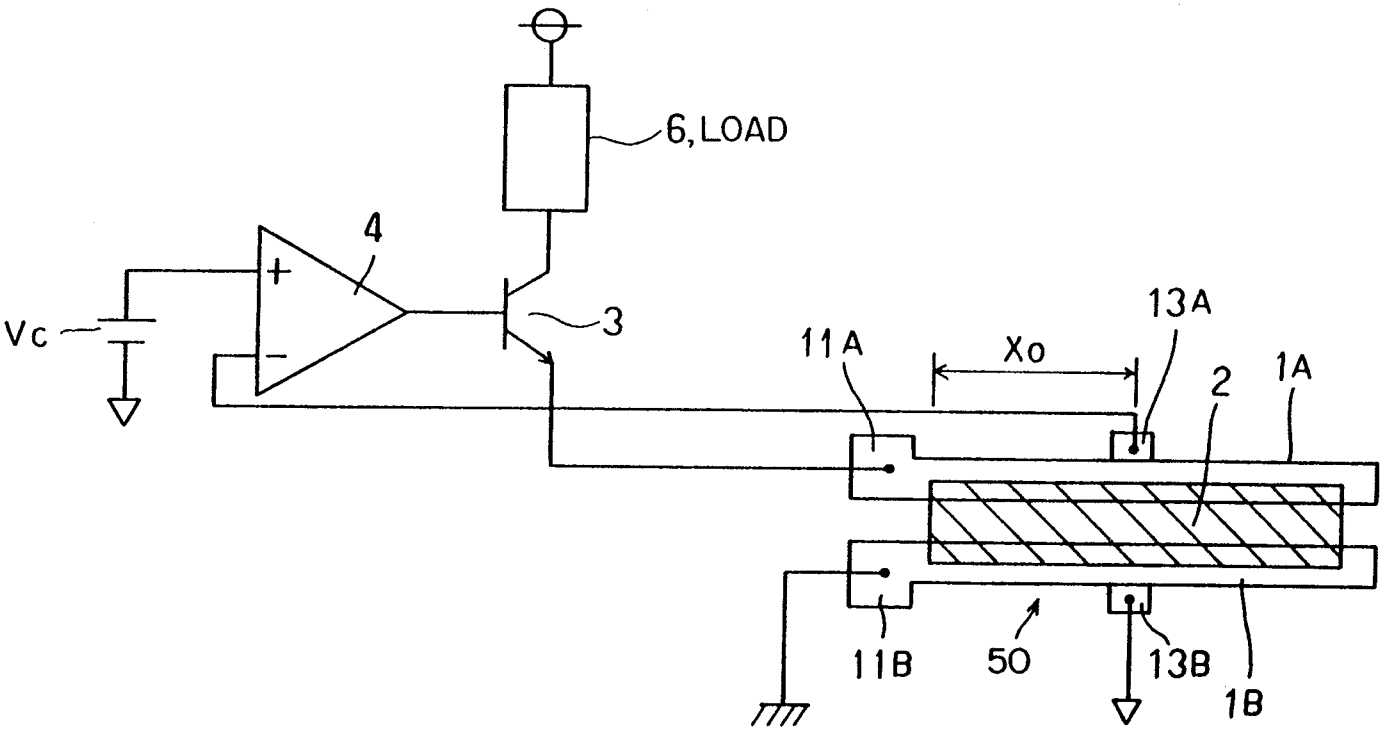
FIG. 1 shows a constant-current circuit in which a resistor circuit according to an embodiment is used.
Figure 2A:
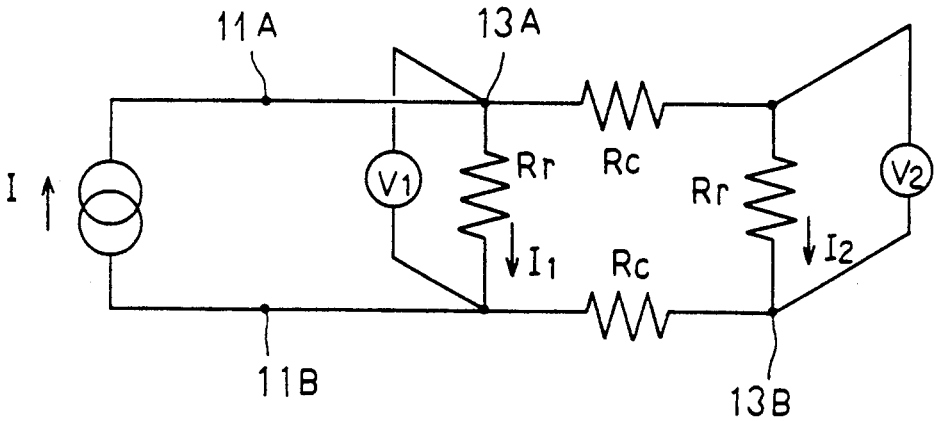
FIGS. 2A and 2B are conceptual views for explaining the present invention.
Figure 2B:
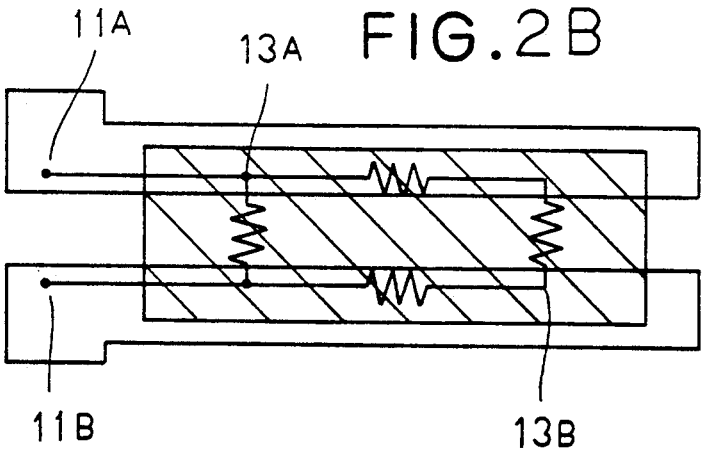

FIG. 1 shows a constant-current circuit in which a resistor 50 according to a first embodiment of the present invention is used. Linear conductive films 1A and 1B are formed parallel one another. A rectangular resistive film 2 is formed on an area between the conductive films 1A and 1B. One side of the resistive film 2 is electrically connected to the conductive film 1A, and another side, opposite to the one side, is electrically connected to the conductive film 1B. The resistor 5 is composed of the conductive films 1A and 1B and the resistive film 2. A supply voltage terminal 11A is connected to one end of the conductive film 1A. The supply voltage terminal 11A is connected to an emitter terminal of a transistor 3. The transistor 3 is a current source for the resistor 5. A ground terminal 11B is connected to one end of the conductive film 1B. The one end of the conductive film 1B is grounded to a power supply ground line. The one end of the conductive film 1A and the one end of the conductive film 1B are formed on the same side.

A voltage output terminal 13A is connected to the conductive film 1A and is disposed at a predetermined distance Xo from one end of the resistive film 2 where the supply voltage terminal 11A is located. The voltage output terminal 13A is connected to an inverting input terminal of an operational amplifier 4. A voltage output terminal 13B is connected to the conductive film 1B and is disposed at the predetermined distance Xo from the one end of the resistive film 2. The voltage output terminal 13B is grounded to a logic ground line.

A constant-voltage Vc is connected between a non-inverting input terminal of the operational amplifier 4 and the logic ground line. This constant voltage can be from a zener diode, or 3-terminal regulator, for example. An output terminal of the operational amplifier 4 is connected to a base terminal of the transistor 3. Load 6 is connected between a collector terminal of the transistor 3 and a power supply.

A load current flows into the supply voltage terminal 11A through the transistor 3, flows in the resistor 50, and flows from the ground terminal 11B to the power supply ground line. The voltage between the voltage output terminals 13A and 13B is proportional to the current. The voltage is compared with the constant-voltage Vc by the operational amplifier 4, which produced an output signal in accordance with the difference between the voltage and the constant-voltage Vc to the transistor 3. The transistor 3 is controlled by the output signal so that a constant-current flows in the load 6.

The voltage between the voltage output terminals 13A and 13B is kept constant regardless of any variation of ambient temperature by disposing the voltage output terminals 13A and 13B at the distance Xo.

The preferred way of determining distance Xo will be described with reference to FIGS. 3-5.

Figure 3:
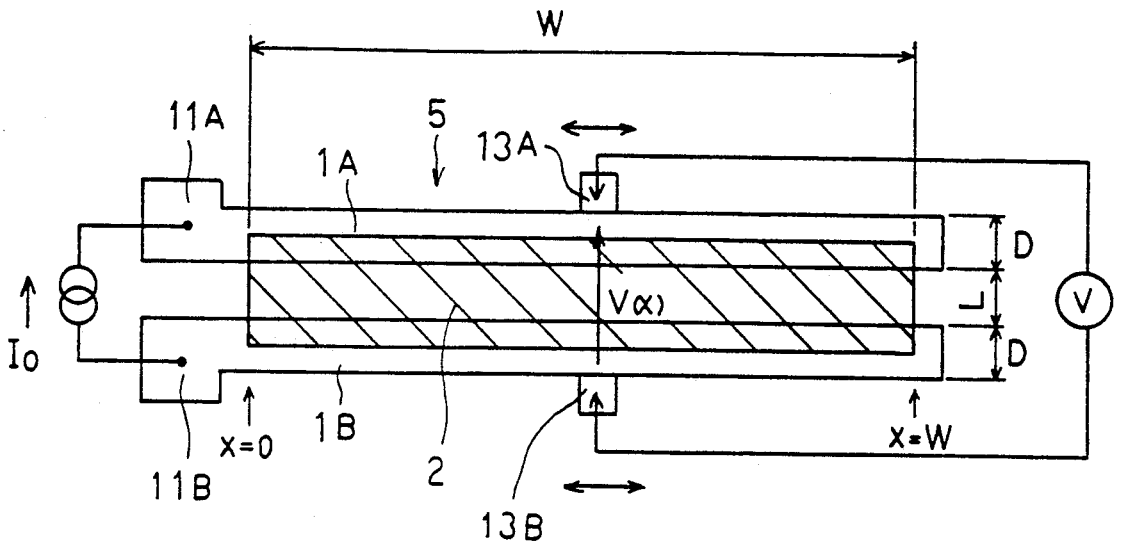
FIG. 3 is a schematic view of the electrode structure shown in FIG. 1.
Figure 4:
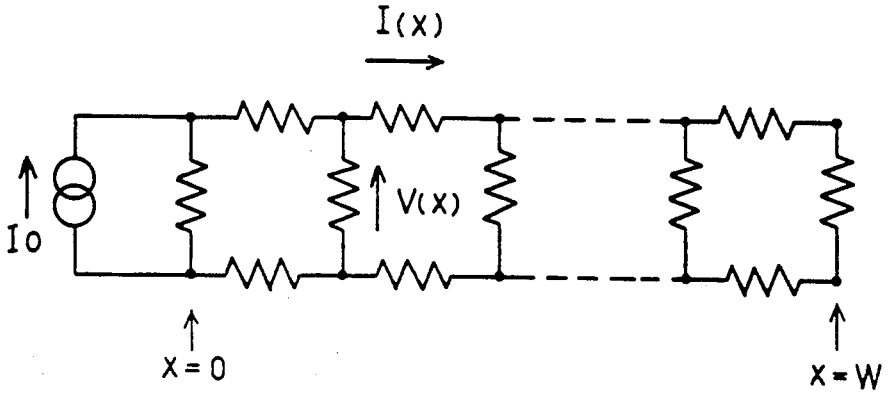
FIG. 4 shows a distributed parameter circuit constructed by a resistor ladder.

A distance X is defined as the distance from the one end of the resistive film 2 in FIG. 3. The one end is the closest portion of the resistive film 2 to the supply voltage terminal 11A or the ground terminal 11B. The resistor 50 is regarded as a distributed parameter circuit constructed by a resistor ladder equivalently shown in FIG. 4. The distributed parameter circuit is represented by the following partial differential equations (1) and (2):

$$\frac{\partial V(x)}{\partial x} = -RI(x) \tag{1}$$

$$\frac{\partial I(x)}{\partial x} = -GV(x) \tag{2}$$

wherein R denotes double the resistance per unit length of the conductive films 1A and 1B; and G denotes the conductance per unit length of the resistive film 2.

Voltage V(X) is represented by the following equation (3) by solving the equations (1) and (2), wherein boundary condition is as follows: I(0)=Io; I(W)=0.

$$V(x) = \sqrt{\frac{R}{G}} \cdot Io \cdot \frac{\cosh(\sqrt{RG}\,(W-x))}{\sinh(\sqrt{RG}\,W)} \tag{3}$$

wherein, W denotes the width of the resistive film 2.

When the ambient temperature changes, R, G and V(X) are denoted by R', G' and V'(X) respectively. In this case, the change V(X) of the voltage is represented by the following equation(4):

$$\Delta V(x) = Io\left(\sqrt{\frac{R'}{G'}} \cdot \frac{\cosh(\sqrt{R'G'}\,(W-x))}{\sinh(\sqrt{R'G'}\,W)} - \sqrt{\frac{R}{G}} \cdot \frac{\cosh(\sqrt{RG}\,(W-x))}{\sinh(\sqrt{RG}\,W)}\right) \tag{4}$$

When the conductive films 1A and 1B are made of, for example, Ag-Pt, its TCR is +2000 ppm/°C., and sheet-resistivity is 3Ω/□. When the resistive film 2 is made of, for example, resistive material including $RuO_2$ as base material, its TCR is +100 ppm/°C., and sheet-resistivity is 3Ω/□. Here, suppose that the temperature of the atmosphere changes by 100° C. in the range of 25° C.-125° C., the width D of the conductive films 1A and 1B and the length L of the resistive film 2 are both 1 mm, and the current Io flowing between the conductive films 1A and 1B is 1 ampere. The necessary condition on which the distance Xo exists is ΔV(W)<0, wherein the distance Xo satisfies the following equation: ΔV(Xo)=0. In this case, the above-mentioned equation (4) is transformed into the following equation (5), and $\sqrt{R'/R}$ and $\sqrt{G/G'}$ in the equation (5) are calculated as shown in the following equations (6) and (7) respectively:

$$\sqrt{\frac{R'}{R}} \cdot \sqrt{\frac{G}{G'}} \cdot \sinh(\sqrt{RG}\,W) - \sinh(\sqrt{R'G'}\,W) < 0 \tag{5}$$

$$\sqrt{\frac{R'}{R}} = \sqrt{1 + 2000\ \text{ppm/°C.} \times 100°\ \text{C.}} = \sqrt{1.2} \tag{6}$$

$$\sqrt{\frac{G}{G'}} = \sqrt{1 + 100\ \text{ppm/°C.} \times 100°\ \text{C.}} = \sqrt{1.01} \tag{7}$$

Substituting the equations (6) and (7) for the equation (5) arrives at the following equation: $RGW^2 > 0.325$. Furthermore, this equation is transformed into the following equation: $W^2/DL > 1.63 \times 10^2$. Solving this equation finds that W>13.

Therefore, the distance Xo need be any width W is more than 13 mm. For example, when the width W is 25 mm, the relationship between the distance X and the voltage V(x) is shown in FIG. 5, wherein the temperatures of the atmosphere are 25° C. and 125° C. FIG. 5 shows the distance Xo is 10 mm.

As explained above, according to the electrode structure of the present embodiment, because the voltage output terminals 13A and 13B are disposed at the above-mentioned distance Xo, the output voltage between the voltage output terminals 13A and 13B is exactly proportional to the current flowing between them without an influence of change of the atmospheric temperature.

Namely, the equivalent TCR of the resistor 5 is substantially zero(0).

Second Embodiment

Figure 5:
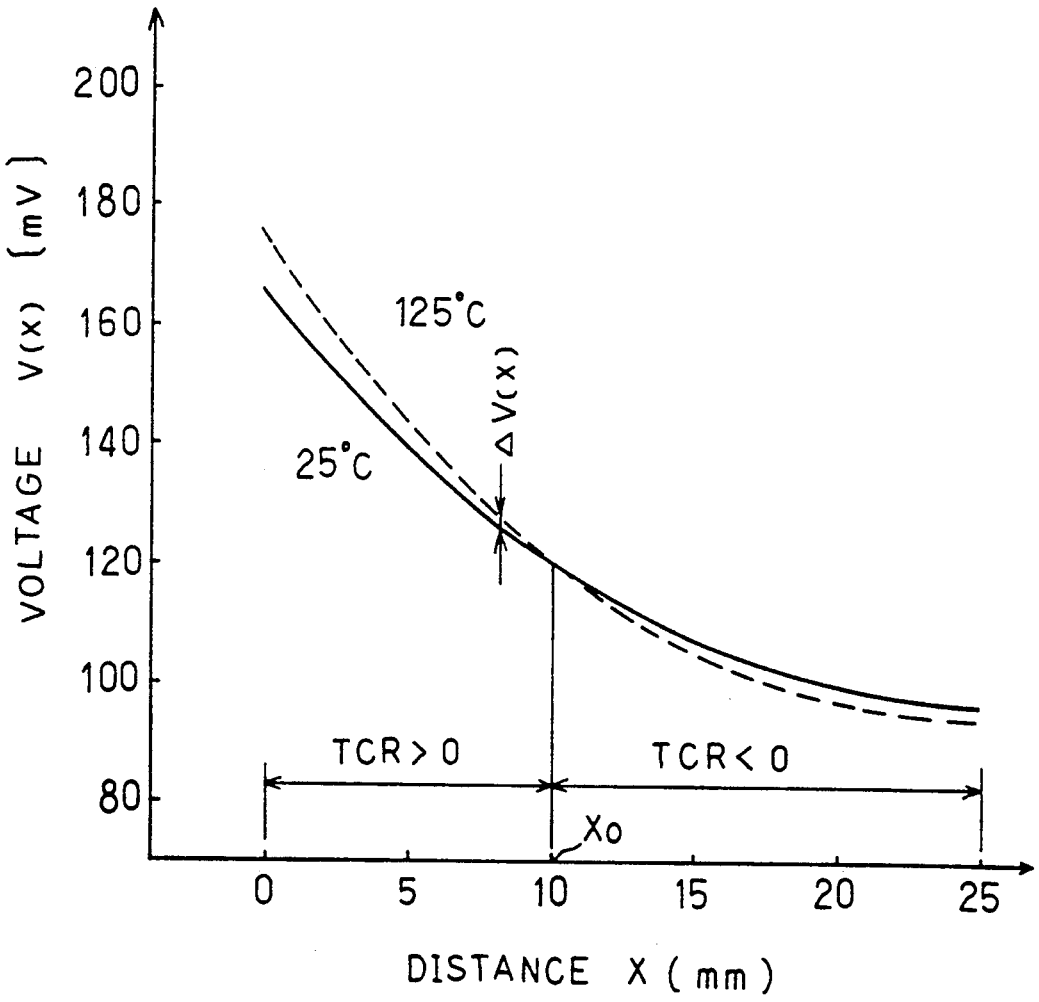
FIG. 5 shows the relationship between a distance X and a voltage V(X)
Figure 6:
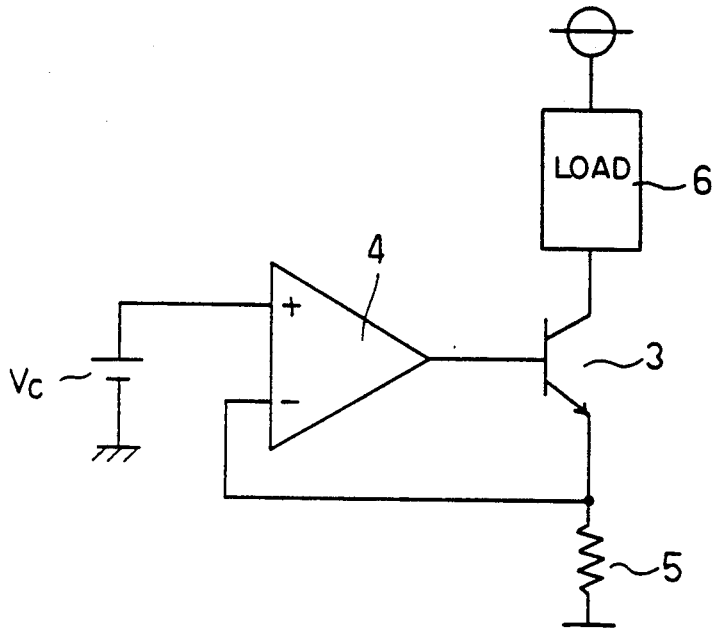
FIG. 6 shows a conventional constant-current circuit.
Figure 8:
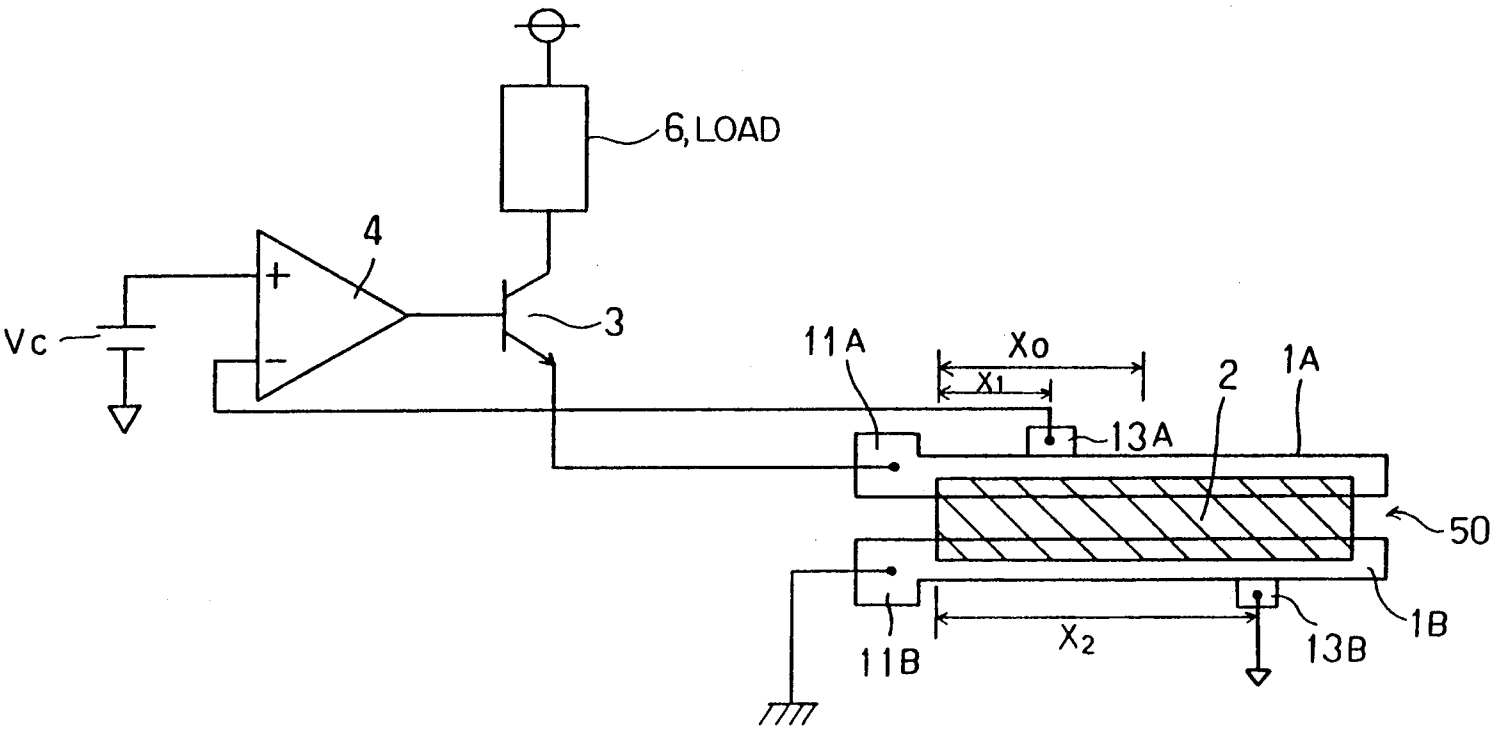
FIG. 8 shows a constant-current in which a resistor circuit according to a second embodiment is used.

FIG. 5 shows that when the distance X is longer than the distance Xo, the change $\Delta V(X)$ of the voltage becomes negative. The longer the distance X, the larger the absolute value of the change $\Delta V(X)$. When both the voltage output terminals 13A and 13B cannot be disposed at the same distance Xo due to spatial restriction, the voltage output terminals 13A and 13B may be disposed at the distance X1 and X2, respectively, wherein $\Delta V(X1) = -\Delta V(X2)$. The distance X1 is shorter than the distance Xo, and the distance X2 is longer than the distance Xo as shown in FIG. 8. The second embodiment has the same effect as the first embodiment.

Third Embodiment

Figure 7:
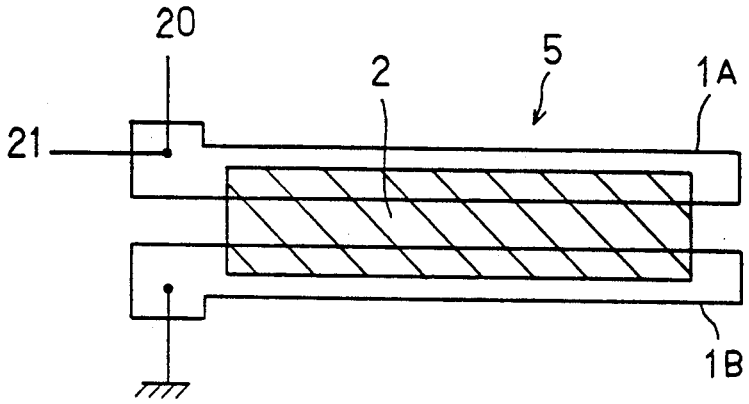
FIG. 7 is a schematic view of a conventional electrode structure.
Figure 9:
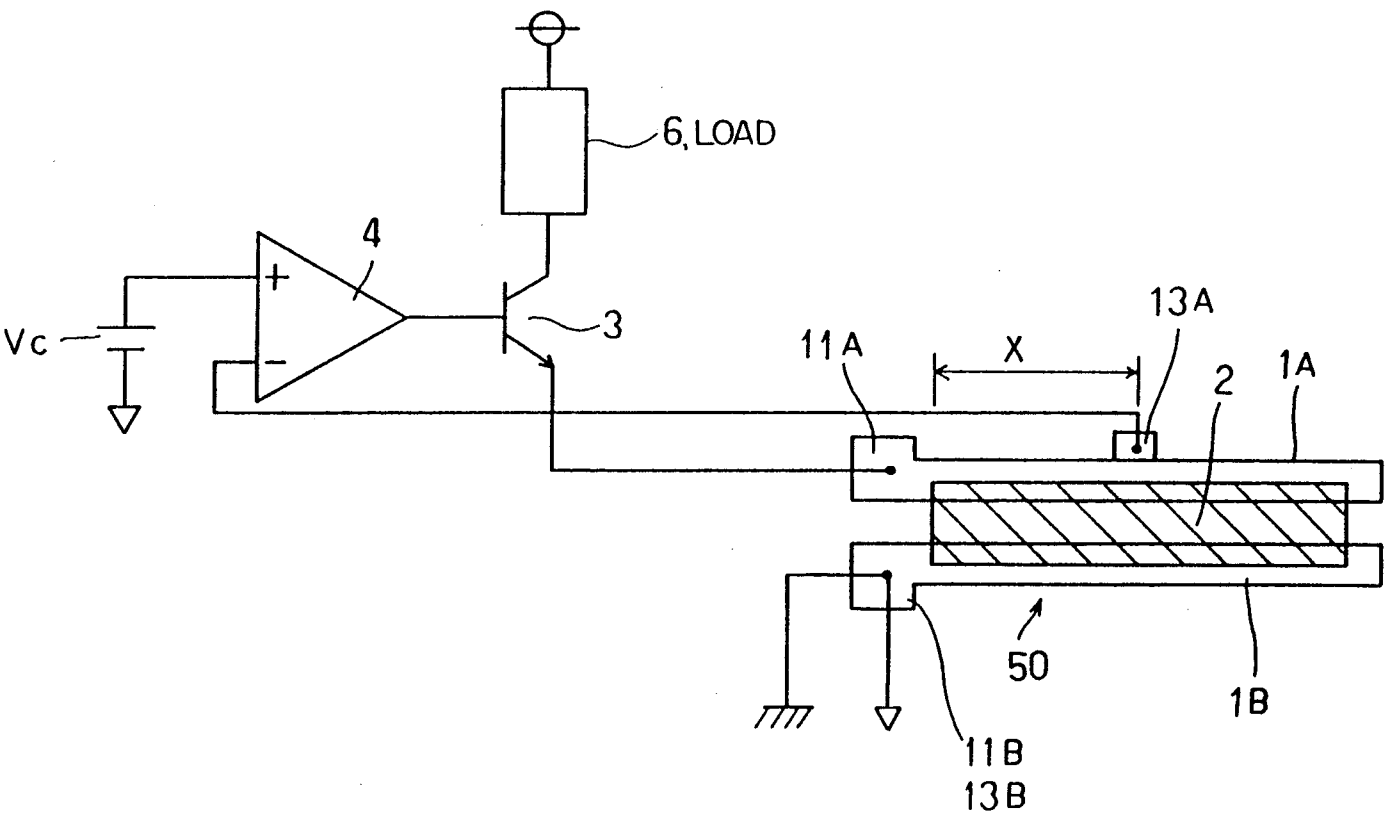
FIG. 9 shows a constant-current circuit in which a resistor circuit according to a third embodiment is used.

One of the voltage output terminals 13A and 13B may be disposed at the same position in which the supply voltage terminal 11A or the ground terminal 11B is formed as shown in FIG. 9. The change $\Delta V(X)$ of the voltage at the position other than the supply voltage terminal 11A or the ground terminal 11B is smaller than the change $\Delta V(0)$ of the voltage at the supply voltage terminal 11A or the ground terminal 11B. The change of the voltage V(0,X) between the voltage output terminals 13A and 13B is $(\Delta V(X)+\Delta V(0))/2$. Therefore, TCR of the resistor of the present embodiment is lower than that of the resistor shown in FIG. 7.

The present invention has been described with reference to the above-mentioned embodiments, but the present invention is not limited to these embodiments and can be modified without departing from the spirit or concept of the present invention. For example, the supply voltage terminal 11A or the ground terminal 11B may be connected to the portion other than the end of the conductive film 1A or the conductive film 1B.

What is claimed is:

1. A resistor circuit, comprising:

a pair of linear conductive films;

a resistive film formed on an area between said conductive films and electrically connected to said conductive films;

a pair of resistor terminals electrically connected to first and second portions of said conductive films respectively;

a current source, electrically connected between said resistor terminals, to produce an electric current between said terminals; and a pair of voltage output terminals electrically connected to third and fourth portions of said conductive films respectively, at least one of said third and fourth portions where said voltage output terminals are disposed being at a position different than either of said first or second positions where said resistor terminals are formed.

2. A resistor circuit according to claim 1, wherein said conductive films are substantially parallel to each other, and a shape of said resistive film is rectangular.

3. A resistor circuit according to claim 1, wherein a positive temperature coefficient of resistance of said resistive film is lower than that of said conductive films.

4. A resistor circuit according to claim 1, wherein said resistor terminals are connected to ends of said conductive films.

5. A resistor circuit according to claim 4, wherein one of said voltage output terminals is disposed at a predetermined distance form one end of said resistive film near said resistor terminals.

6. A resistor circuit according to claim 5, wherein an other of said voltage output terminals is also disposed at said predetermined distance from said one end of said resistive film near said resistor terminals.

7. A resistor circuit as in claim 5 wherein the other voltage output terminal is disposed at said resistor terminal.

8. A resistor circuit according to claim 5 wherein the other voltage output terminal is disposed a different predetermined distance from said one end of said resistive film near said resistor terminals.

9. A resistor circuit according to claim 1, wherein said conductive films are made of Ag-Pt, and said resistive films are made of resistive material including $RuO_2$ as base material.

10. A resistor circuit according to claim 1, wherein said current source includes a transistor, an emitter terminal of said transistor being electrically connected to one of said resistor terminals, and further comprising:

a load connected between a collector terminal of said transistor and a power supply; and an operational amplifier, one of said voltage output terminals being connected to an inverting input terminal of said operational amplifier, a non-inverting input terminal of said operational amplifier being connected to a constant-voltage, and an output terminal of said operational amplifier being connected to a base terminal of said transistor.

11. A temperature-compensated resistor circuit comprising:

first and second linear conductive films;

a resistive film formed connected between said conductive films;

a pair of resistor terminals connected to first and second portions of said conductive films respectively to thereby form terminals between which a resistance of said resistor film is defined;

first and second voltage output terminals, electrically connected to third and fourth portions of said conductive films respectively, at least one of said third and fourth portions being different than at least one of said first and second portions, and said third and fourth positions being positions which offset any changes in resistance caused by ambient temperature.

* * * * *

UNITED STATES PATENT AND TRADEMARK OFFICE

CERTIFICATE OF CORRECTION

PATENT NO. : 5,254,938

DATED : OCTOBER 19, 1993

INVENTOR(S) : ITO ET AL

It is certified that error appears in the above-identified patent and that said Letters Patent is hereby corrected as shown below:

On title page, item [19] "Ito" should read --Ito, et al--

On title page, change, item

"(54) Inventor: Hajime Ito, Ichinomiya, Japan"

to

--(54) Inventors: Hajime Ito, Ichinomiya, Japan and Takashi Nagasaka, Anjo-city, Japan.--

Signed and Sealed this

Third Day of May, 1994

Bruce Lehman

BRUCE LEHMAN

*Commissioner of Patents and Trademarks*

*Attest:*

*Attesting Officer*